US007358952B2

(12) United States Patent
Mamba et al.

(10) Patent No.: US 7,358,952 B2
(45) Date of Patent: Apr. 15, 2008

(54) DISPLAY DEVICE FOR DISPLAYING A PLURALITY OF IMAGES ON ONE SCREEN

(75) Inventors: Norio Mamba, Kawasaki (JP); Yasuyuki Kudo, Fujisawa (JP); Hideo Sato, Hitachi (JP)

(73) Assignee: Hitachi Displays, Ltd., Mobara (JP)

( * ) Notice: Subject to any disclaimer, the term of this patent is extended or adjusted under 35 U.S.C. 154(b) by 594 days.

(21) Appl. No.: 10/901,246

(22) Filed: Jul. 29, 2004

(65) Prior Publication Data

US 2005/0057475 A1 Mar. 17, 2005

(30) Foreign Application Priority Data

Sep. 17, 2003 (JP) ..... 2003-323897

(51) Int. Cl.
*G09G 3/36* (2006.01)

(52) U.S. Cl. ..... 345/99; 345/214

(58) Field of Classification Search ..... 345/87–90, 345/92–100, 103–104, 204–206, 208–214; 349/139, 142–143, 149
See application file for complete search history.

(56) References Cited

U.S. PATENT DOCUMENTS 4,842,371 A * 6/1989 Yasuda et al. ..... 345/96
5,604,511 A * 2/1997 Ohi ..... 345/98
6,310,592 B1 * 10/2001 Moon et al. ..... 345/87
6,366,271 B1 * 4/2002 Kohno et al. ..... 345/103
6,559,822 B2 * 5/2003 Okuzono ..... 345/96
2002/0075249 A1 6/2002 Kubota et al.

FOREIGN PATENT DOCUMENTS

JP 2002-032048 1/2002

* cited by examiner

*Primary Examiner*—Richard Hjerpe
*Assistant Examiner*—Mansour M. Said
(74) *Attorney, Agent, or Firm*—Mattingly, Stanger, Malur & Brundidge, PC

(57) ABSTRACT

A plurality of horizontal display control lines CTL are arranged in parallel with signal lines D and connected to switching elements ctl of pixels. Among pixels whose switching elements sw become an On state owing to a selection voltage from a gate line G, switching elements ctl of pixels for which display signals are not rewritten are turned off not to apply a display signal to liquid crystal cells of those pixels. And pixels for which display signals are to be rewritten, the horizontal display control circuit 109 applies a rewrite selection signal to those pixels to turn on switching elements ctl of those pixels. Thus, applying display signals that are outputted from a signal circuit and correspond to those pixels having the switching elements ctl turned on to liquid crystal cells of those pixels, display signals are rewritten.

11 Claims, 11 Drawing Sheets

DISPLAY DEVICE FOR DISPLAYING A PLURALITY OF IMAGES ON ONE SCREEN

BACKGROUND OF THE INVENTION

The present invention relates to a display device for displaying a plurality of images of different signal sources on one screen.

Generally, a conventional display device has only one circuit as a signal line driving circuit and only one circuit as a gate line scanning circuit. Accordingly, video signals of all formats (for example, a picture signal of a photograph or the like requiring high definition and a picture signal of a portable device standby screen for which low definition is good enough) are displayed by operation of the same circuits and accordingly power consumption scarcely changes.

Recently, considering this problem, is proposed a display device that can drive signal lines according to various demands and can display a plurality of picture data in superposition without previously synthesizing them, and also is proposed an electronic device using such a display device.

US2002/0075249(JP-A-2002-32048) describes a picture display device provided with a plurality of data signal line driving circuits of respective different configurations and a plurality of scanning signal line driving circuits of respective different configurations. Each data signal line driving circuit or scanning line driving circuit can display a picture of a different format from the others. By switching a driving circuit to operate, depending on types of images to be inputted or use environment, it is possible to realize display according to the optimum display format and to reduce power consumption. Further, overwriting of pictures can be realized when a plurality of driving circuits are used to write respective video signals into signal lines being delayed from each other. Thus, it is possible to display a plurality of pictures in superposition, without externally processing video signals.

However, it is difficult for the technique disclosed in US2002/0075249(JP-A-2002-32048) to arbitrarily control superposition (overwriting) of images on one horizontal line. Further, to synthesize and display two signals having different frame rates, it is necessary to synchronize those two signals, and it becomes a burden on external systems (systems for outputting a video signal and a picture signal).

SUMMARY OF THE INVENTION

The present invention helps provide a display device that can synthesize and display a plurality of display signals in a horizontal direction.

The present invention helps provide a display device that can asynchronously display a plurality of display signals having different periods.

A display device of the present invention comprises a plurality of horizontal display control lines arranged in parallel with signal lines, and a horizontal display control circuit that applies a rewrite selection signal onto horizontal display control lines for controlling display signals in a plurality of pixels connected to a gate line. Each pixel comprises at least two switching elements sw and ctl and a liquid crystal cell. The switching element sw included in a pixel is controlled by a gate line and the other switching element ctl is controlled by a horizontal display control line. As for pixels for which display signals are not to be rewritten among a plurality of pixels whose switching elements sw become an On state owing to a selection voltage applied to a gate line, switching elements ctl included in those pixels are turned off not to apply display signals to the liquid crystal cells of those pixels. As for pixels for which display signals are to be rewritten, the horizontal display control circuit applies rewrite signals to those pixels to turn on the switching elements ctl included in those pixels, and the signal circuit outputs display signals corresponding to those pixels to apply those display signals to the liquid crystal cells of those pixels so that the display signals are rewritten.

Further, a display device of the present invention comprises a horizontal display control circuit which outputs display signals that are generated by a signal circuit and correspond to pixels for which display signals are to be rewritten, onto signal lines corresponding to those pixels, among a plurality of pixels connected to a gate line to which the selection voltage is applied, and which outputs a potential that is at least lower (or higher) than a potential that is higher (or lower) than the selection voltage by a threshold voltage of a TFT element of each pixel. The display device further comprises a common driving circuit which outputs a common electrode voltage as a reference potential to display signals outputted by the signal circuit, onto common lines corresponding to the pixels for which display signals are to be rewritten, among the plurality of pixels connected to the gate line to which the selection voltage is applied, and which applies a voltage to common lines corresponding to the pixels for which display signals are not to be rewritten such that pixel electrode voltages of the pixels have at least a lower (or higher) potential than a potential that in turn is higher (or lower) than the selection voltage by the threshold voltage of the TFT element. As for the pixels for which display signals are to be rewritten among the pixels connected to the gate line to which the selection voltage is applied, the TFT elements of those pixels are turned on so that display signals corresponding to the liquid crystal cells of the pixels and a storage capacity are applied and rewritten. And as for the pixels for which display signals are not to be rewritten, the TFT elements of those pixels are turned off so that those pixels perform holding operation.

According to the present invention, it is possible to synthesize and display a plurality of display signals in a horizontal direction.

According to the present invention, it is possible to asynchronously display a plurality of display signals having different periods.

DETAILED DESCRIPTION OF THE PREFERRED EMBODIMENTS

In the following, embodiments will be described taking examples of liquid crystal display devices each using liquid material in a pixel part. However, fundamental structure and driving methods of the embodiments can be applied also to a display device using electroluminescence material or light emitting diode elements in a pixel part.

First, a display device and a driving method of a first embodiment according to the present invention will be described referring to FIG. 1 through FIG. 10.

Figure 1:
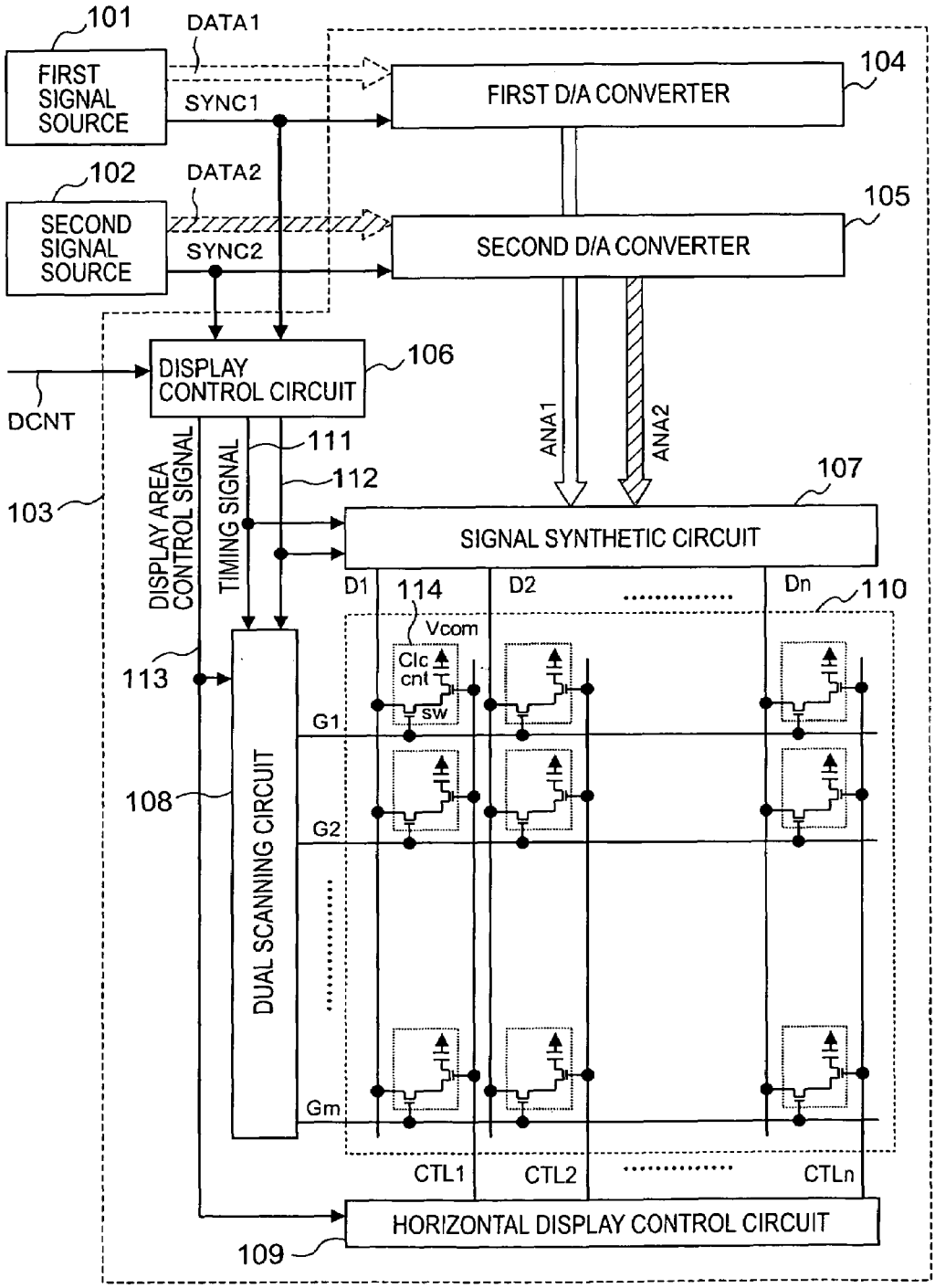
FIG. 1 is a schematic diagram showing a configuration of a display device in a first embodiment of the present invention.

FIG. 1 is a schematic diagram showing the display device of the first embodiment according to present invention. In the following, a configuration of the display device will be described. In FIG. 1, a first signal source 101 outputs a digital display signal DATA1 as a first video signal and a control signal SYNC1 to the display device 103. A second signal source 102 outputs a digital display signal DATA2 as a second video signal and a control signal SYNC2 to the display device 103. The display device 103 comprises a first D/A converter 104, a second D/A converter 105, a display control circuit 106, a signal synthetic circuit 107, a dual scanning circuit 108, a horizontal display control circuit 109 and a pixel array 110. Here, the number of signal sources may be three or more.

The pixel array 110 comprises: pixels 114 arranged in a matrix having n (n is a natural number) pixels in each horizontal line and m (m is a natural number) pixels in each vertical line (column); n signal lines D1, D2, . . . , Dn arranged for supplying the display signals to the pixels; n horizontal display control lines CTL1, CTL2, . . . , CTLn arranged for controlling display areas in the horizontal direction, and m gate lines G1, G2, . . . , Gm arranged for selecting n pixels arranged in the horizontal direction (hereinafter, referred to as one horizontal line) out of the pixels arranged in the matrix.

Figure 2:
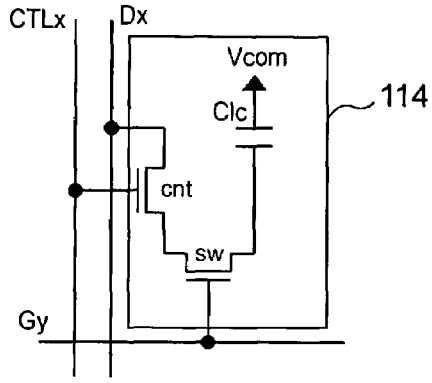
FIG. 2 is a diagram showing a configuration of a pixel in the first embodiment.

Now, will be described a pixel 114. Each pixel 114 comprises two switching elements sw and cnt, a liquid crystal capacity Clc, and a common electrode to which a common electrode voltage Vcom is applied. Here, description is given taking an example where an n-type thin film transistor (TFT) is used as each switching element, though the switching elements are not limited to this type. Further, although not shown, a storage capacity for retaining an effective voltage of the liquid crystal capacity Clc is provided. In FIG. 1, as for the switching element sw, its gate terminal is connected to a gate line G, its drain terminal (or its source terminal) to a signal line D, and its source terminal (or its drain terminal) to the switching element cnt. On the other hand, as for the switching element cnt, its gate terminal is connected to a horizontal display control line CTL, its drain terminal (or its source terminal) to the switching element sw, and its source terminal (or its drain terminal) to a pixel electrode that applies the display signals to the liquid crystal capacity Clc. The other electrode of the liquid crystal capacity Clc is the common electrode. Here, the liquid crystal capacity Clc is applied with a potential difference between the pixel electrode and the common electrode. When the pixel 114 is in a state that the gate line G and the horizontal display control line CTL are selected, then an analog display signal transferred from the signal line D is applied to the pixel electrode. FIG. 2 shows another configuration of each pixel 114 of the first embodiment. As for a switching element cnt shown in FIG. 2, its gate terminal is connected to a horizontal display control line CTLx, its drain terminal (or its source terminal) to a signal line Dx, and its source terminal (or its drain terminal) to a switching element sw. As for a switching element sw, its gate terminal is connected to a gate line Gy, its drain terminal (or its source terminal) to the switching element cnt, and its source terminal (or its drain terminal) to a pixel electrode that applies the analog display signal to a liquid crystal capacity Clc. Also in the case of the pixel 114 shown in FIG. 2, in a state that the gate line Gy and the horizontal display control line CTLx are selected, the analog display signal transferred from the signal line Dx is applied to the pixel electrode. It is assumed that the pixels 114 included in the pixel array 110 of the present embodiment have the configuration of FIG. 1 or 2. It is favorable that the analog display signal has voltages respectively defined for gradations (gradation voltages).

Further, in the schematic diagram of FIG. 1 showing the display device, the display control circuit 106 receives the control signal SYNC1 outputted from the first signal source 101, the control signal SYNC2 outputted from the second signal source 102 and a display control signal DCNT for controlling display states of the first and second video signals in the display device 103, and outputs a timing signal 111 which controls display timing of the first video signal, a timing signal 112 which controls display timing of the second video signal and a display area control signal 113 which controls display areas. Further, the first D/A converter 104 receives the digital display signal DATA1 as the first video signal, converts the received signal into an analog display signal ANA1, and outputs the analog display signal ANA1 to the signal synthetic circuit 107. The second D/A converter 105 receives the digital display signal DATA2 as the second video signal, converts the received signal into an analog display signal ANA2, and outputs the analog display signal ANA2 to the signal synthetic circuit 107. The signal synthetic circuit 107 receives ANA1 as the first video signal and ANA2 as the second video signal, synthesizes the signals based on the timing signals 111 and 112 outputted from the display control circuit 106, and outputs the synthesized signal onto the signal lines D1, D2, . . . , Dn. Further, the dual scanning circuit 108 receives the timing signals 111 and 112 and the display area control signal 113 outputted from the display control circuit 106, and selects a gate line G1, G2, . . . , or Gm based on the signals. Further, the horizontal display control circuit 109 receives the display area control signal 113 outputted from the display control circuit 106 and drives the horizontal display control lines CTL1, CTL2, . . . , CTLn.

Accordingly, in the display device shown in FIG. 1, among pixels connected to a gate line G to which a selection voltage is applied by the dual scanning circuit 108 from the signal synthetic circuit 107, the display signals are applied to pixels to whose horizontal display control lines CTL is applied a selection signal by the horizontal display control circuit 109.

Here, in the display device shown in FIG. 1, the pixel array 110 may be formed by amorphous Si on a glass substrate and the remaining circuits may be arranged around the glass. Or, the pixel array 110, the dual scanning circuit 108 and the horizontal display control circuit 109 may be formed by polycrystalline Si on a glass substrate and the remaining circuits may be arranged around the glass. Or, the circuits and the pixel array 110 included in the display device 103 may be formed by polycrystalline Si on a glass substrate. Thus, there is no limitation on circuits formed together with the pixel array 110 on a same substrate.

Next, referring to FIGS. 3 and 4, will be described display by the display device 103 of FIG. 1.

Figure 3:
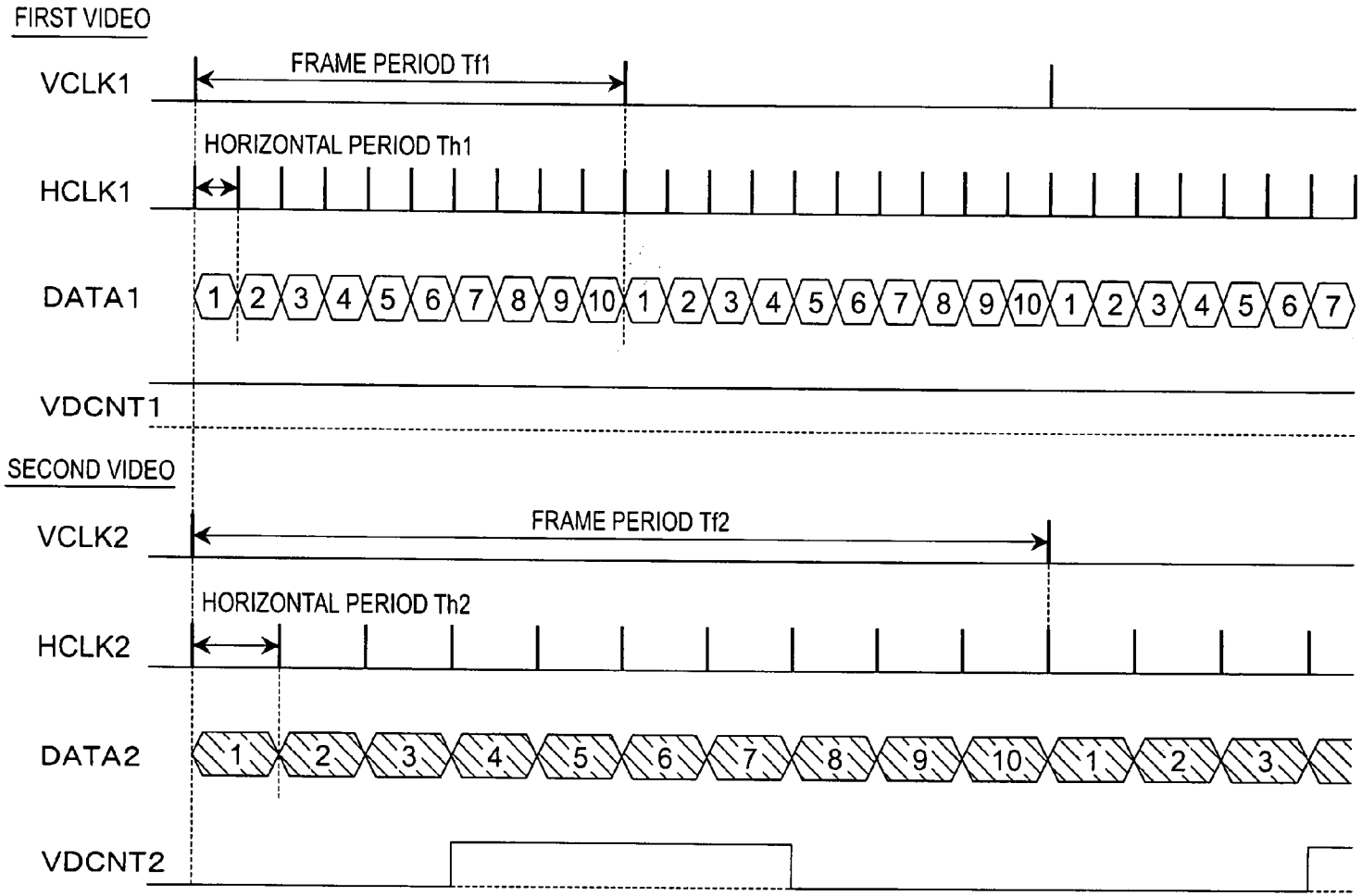
FIG. 3 is a timing chart of video signals and display control signals in the first embodiment.

FIG. 3 is a timing chart showing the signals relating to the first video outputted by the first signal source 101, the signals relating to the second video outputted by the second signal source 102, and vertical display control signals VDCNT in the display control signal DCNT. FIG. 4 simply shows a screen displayed on the display device 103 of the first embodiment of the present invention, according to the signals relating to the first video, the signals relating to the second video, and the display control signal DCNT.

In FIG. 3, the first video signal consists of the digital display signal DATA1 and the control signal SYNC1 as described above, and the signal SYNC1 includes a vertical synchronizing signal VCLK1 and a horizontal synchronizing signal HCLK1. Although not shown in FIG. 3, the signal SYNC1 also includes a dot clock for transferring the digital display signal, a disp signal for judging a scope of the digital display signal, and the like. Here, the first video signal is a signal outputted at a speed of a frame period Tf1 (i.e., a period of the vertical synchronizing signal VCLK1) and a horizontal period Th1 (i.e., a period of the horizontal synchronizing signal HCLK1). Here, the horizontal period Th1 includes the digital display signal corresponding to n pixels, and the frame period Tf1 includes the digital display signal corresponding to m lines. On the other hand, as shown in FIG. 3, the second video signal has the same configuration (kinds) of signals as the first video signal. The second video signal is a signal outputted at speeds of a frame period Tf2 (i.e., a period of the vertical synchronizing signal VCLK2) and a horizontal period Th2 (i.e., a period of the horizontal synchronizing signal HCLK2). Here, the horizontal period Th2 includes the digital display signal corresponding to n pixels, and the frame period Tf2 includes the digital display signal corresponding to m lines. Here, m and n are natural numbers. Further, the embodiments of the present invention are described taking the example where the number of the pixels and the number of the horizontal lines are same between the first and second video signals, although those numbers may be different between the first and second video signals.

Here, it is assumed that the frame period Tf1 (or the horizontal period Th1) of the first video signal is more than or equals to the frame period Tf2 (or the horizontal period Th2) of the second video signal. For the sake of convenience of description, description is given on the assumption that the number m of the horizontal lines is 10 and the frame period Tf2 (or the horizontal period Th2) of the second video signal is twice the frame period Tf1 (or the horizontal period Th1) of the first video signal, although the present invention is not limited to this. Further, the relation between the phases of the first and second video signals is not limited to the one shown in FIG. 3.

Further, signals VDCNT1 and VDCNT2 are vertical display control signals included in the display control signal DCNT. The signal VDCNT1 becomes a display level in horizontal periods in which the first video signal should be displayed on the display device 103, and becomes a non-display level in the other periods. The signal VDCNT2 becomes a display level in horizontal periods in which the second video signal should be displayed on the display device 103, and becomes a non-display level in the other periods. FIG. 3 is shown assuming that a Hi level of the VDCNT signals is defined as the display level, and a Low level is defined as the non-display level. In the example of FIG. 3, VDCNT1 is on the display level (the Hi level) while VDCNT2 is on the display level (the Hi level) in horizontal periods corresponding to the 4th to 7th horizontal lines, and on the non-display level (the Low level) in the other periods.

Figure 4:
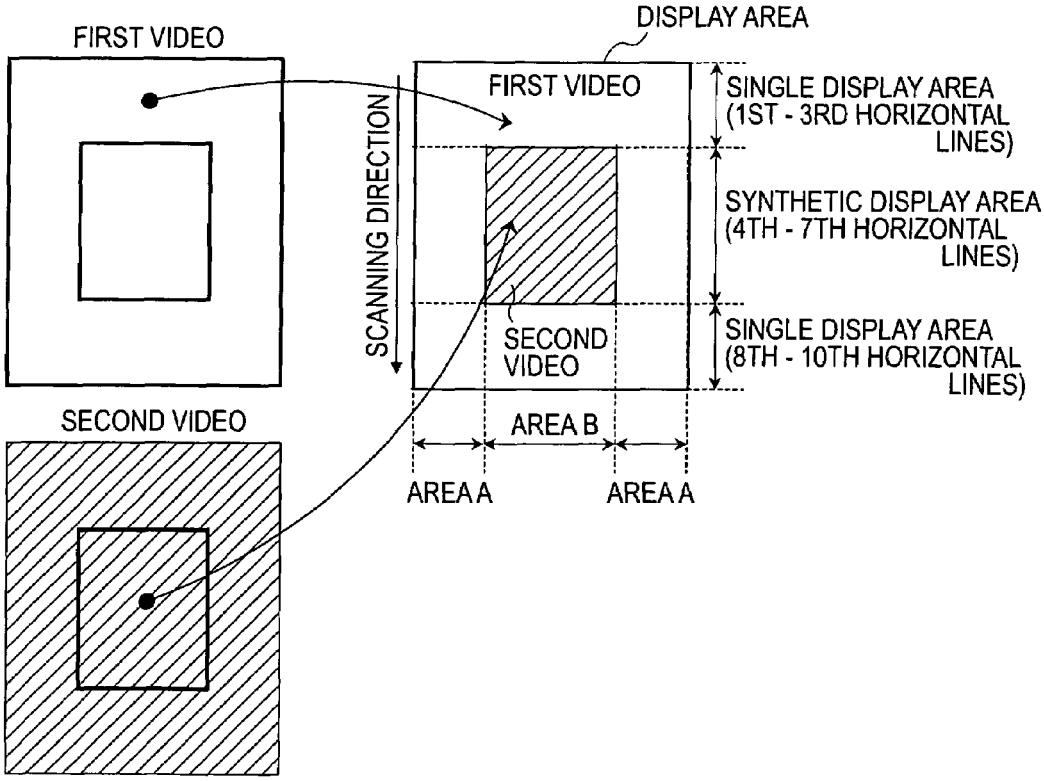
FIG. 4 is a display screen of a display device according to the video signals and the display control signals in the first embodiment.

FIG. 4 simply shows a screen displayed on the display device 103. Control of the screen in the vertical direction (the scanning direction) is performed based on the vertical display control signals VDCNT1 and VDCNT2 shown in FIG. 3. The 1st to 3rd horizontal line and the 8th to 10th horizontal lines becomes display areas (single display areas) in which only the first video signal is displayed. On the 4th to 7th horizontal lines, both VDCNT1 and VDCNT2 are on the display level, thus the 4th to 7th horizontal lines becomes a synthetic display area in which both the first and second video signals are displayed. On the other hand, control of the screen in the horizontal direction (the direction along the horizontal lines) is performed based on a horizontal display control signal HDCNT included in the display control signal DCNT. The control signal HDCNT is a signal for distinguishing between a pixel displaying the first video signal and a pixel displaying the second video signal among the pixels which exist on one horizontal line. Although FIG. 3 does not show the control signal HDCNT, in the single display areas of the 1st to 3rd horizontal lines and the 8th to 10th horizontal lines, the signal HDCNT controls such that all the pixels display the first video signal, while in the synthetic display area of the 4th to 7th horizontal lines, the signal HDCNT controls such that an area A in which the first video signal is displayed and an area B in which the second video signal is displayed are distinguished from each other. As described above, the display device 103 of the present invention displays the second video signal in an area designated by the display control signal DCNT and the first video signal in the other areas.

Next, referring to FIGS. 5 to 10, will be described operation of the display device 103 in the case where the above-described screen shown in FIG. 4 is displayed.

Figure 5:
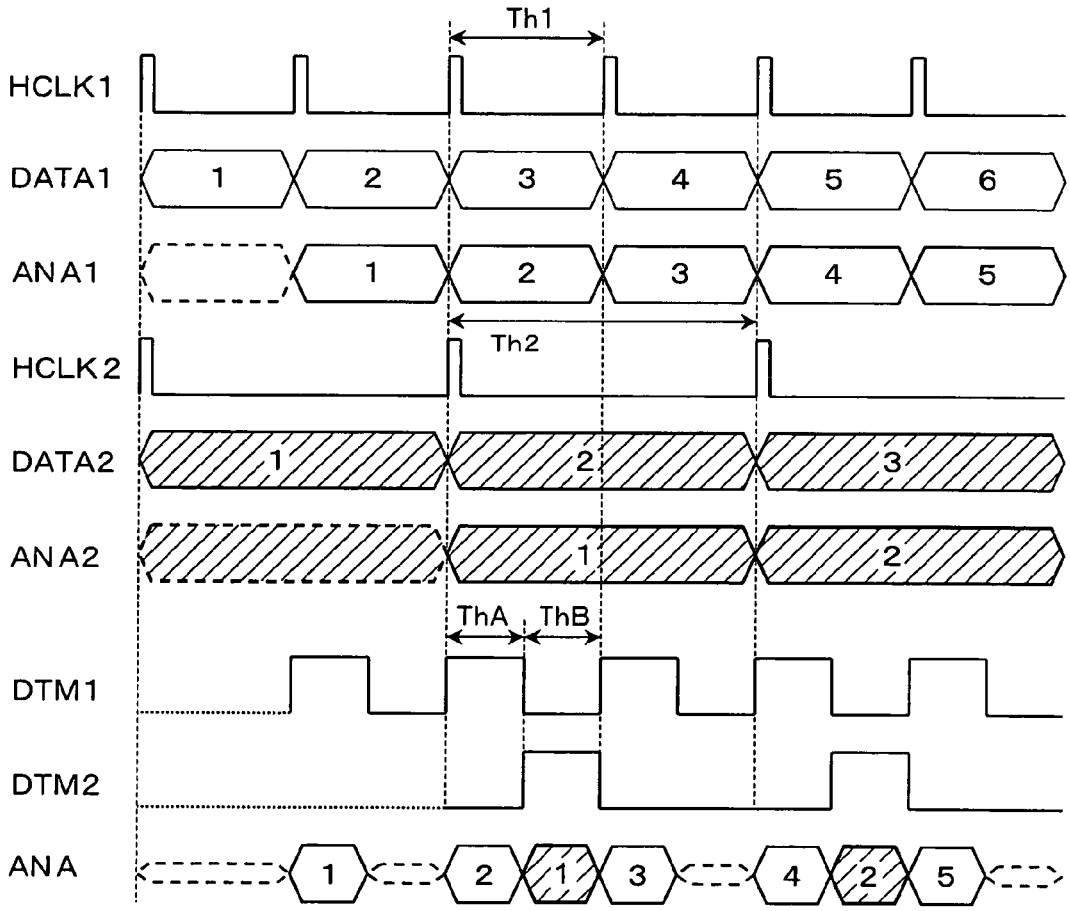
FIG. 5 is a timing chart of a D/A converter and a signal synthetic circuit in the first embodiment.

FIG. 5 is a timing chart showing operations of the first D/A converter 104, the second D/A converter 105 and the signal synthetic circuit 107. The first D/A converter 104 once stores the digital display signal DATA1 for one horizontal line outputted from the first signal source, and thereafter outputs the analog display signal ANA1 for one horizontal line. In FIG. 5, the first D/A converter 104 stores, for example, the digital display signal (for one horizontal line) transferred in one horizontal period Th1, and, in the next horizontal period, outputs the analog display signal corresponding to the stored digital display signal. Similarly, the second D/A converter 105 once stores the digital display signal DATA2 for one horizontal line outputted from the second signal source, and thereafter outputs the analog display signal ANA2 for one horizontal line. In FIG. 5, the second D/A converter 105 stores, for example, the digital display signal (for one horizontal line) transferred in one horizontal period Th2, and, in the next horizontal period, outputs the analog display signal corresponding to the stored digital display signal. In FIG. 5, numbers given to DATA1, DATA2, ANA1 and ANA2 are numbers of corresponding horizontal lines.

The signal synthetic circuit 107 synthesizes the analog display signals ANA1 and ANA2 outputted from the first D/A converter 104 and the second D/A converter 105 to output an analog display signal ANA to be applied to the signal lines D, based on a display timing signal DTM1 (for the first video signal) included in the timing signal 111 from the display control circuit 106 and a display timing signal DTM2 (for the second video signal) included in the timing signal 112.

Here, the display timing signals DTM1 and DTM2 outputted from the display control circuit 106 will be described. Between the first and second video signals, the display control circuit 106 divides a horizontal period of a video signal having a shorter horizontal period into a plurality of periods. In the case where the first and second video signals have the same horizontal period, a horizontal period of either of the video signals is divided along an axis of time. Thus, in the example of the present embodiment, Th1 is shorter than Th2, and each horizontal period Th1 of the first video signal is divided into a plurality of periods (ThA and ThB). Then, the display control circuit 106 assigns one (ThA or ThB) of those plurality of periods resulting from the division of Th1 to displaying the video signal whose horizontal period has been divided (i.e., the first video signal in the example of this embodiment). In the assigned period, the display timing signal DTM1 is outputted at the display level. For example, FIG. 5 shows the case where the display level of DTM1 is the Hi level and the first half period of each divided horizontal period Th1 is assigned to displaying the first video signal. On the other hand, for each horizontal period Th2 of the second video signal, the display control circuit 106 selects one period out of a plurality of periods resulting from the above-mentioned division of periods Th1 within the Th2 except for the periods assigned to displaying the first video signal (i.e., the video signal whose horizontal period has been divided), and assigns the selected period to displaying the second video signal (i.e., the video signal whose horizontal period is not divided). In the assigned period, the display timing signal DTM2 for the second video signal is outputted at the display level. For example, FIG. 5 shows the case where the display level of DTM2 is the Hi level, and, out of the second half periods that are not each assigned to displaying the first video signal, one period is selected within each horizontal period horizontal period Th2 the second video signal of the second video signal, to assign the selected period to displaying the second video signal.

Thus, based on the timing signals outputted from the display control circuit 106, the signal synthetic circuit 107 selects the analog display signal ANA1 of the first video signal in periods where the display timing signal DTM1 for the first video signal is on the display level, and outputs the selected signal as the analog signal ANA to be applied to the signal lines D. On the other hand, in periods where the display timing signal DTM2 for the second video signal is on the display level, the signal synthetic circuit 107 selects the analog display signal ANA2 of the second video signal and outputs the selected signal as the analog signal ANA to be applied to the signal lines D.

Figure 6:
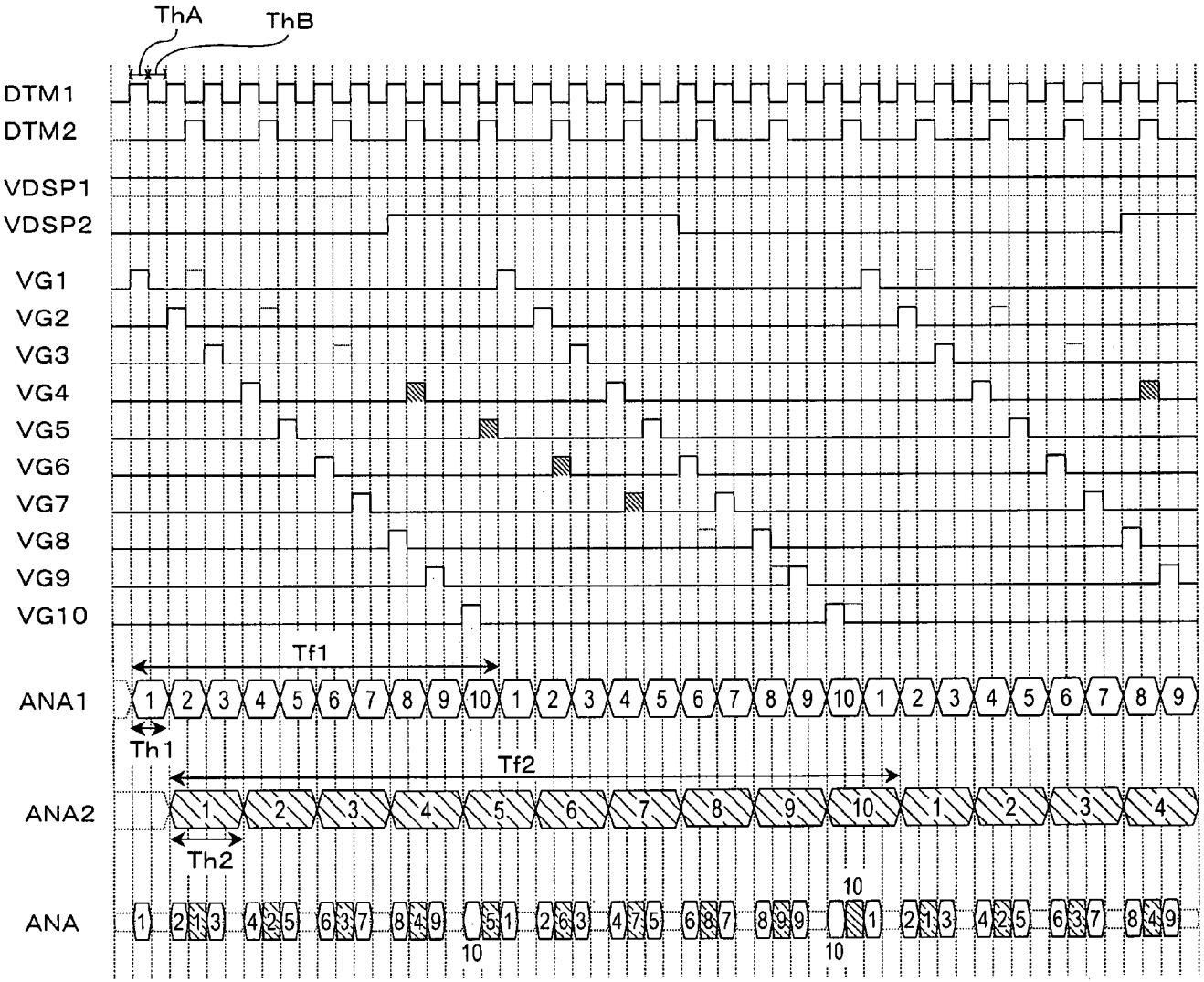
FIG. 6 is a timing chart of a dual scanning circuit in the first embodiment.

FIG. 6 is a timing chart for explaining operation of the dual scanning circuit 108 in the case where the frame period Tf2 of the second video signal is twice the frame period Tf1 of the first video signal. Now, referring to FIG. 6, will be described operation of the dual scanning circuit. In the figure, signals VDSP1 and VDSP2 are vertical display period signals that are generated by the display control circuit 106 referring to timings of the vertical display control signals VDCNT1 and VDCNT2. Signals VG1, VG2, . . . , VG10 are gate line scanning voltage that the dual scanning circuit 108 applies to the gate lines (G1, G2, . . . , G10) of the corresponding horizontal lines (a 1st horizontal line, a 2nd horizontal line, . . . , a 10th horizontal line), respectively. The present embodiment will be described taking the example where an n-type MOS transistor is used as a switching element sw, although the present invention is not limited to this. Here, when a gate line scanning voltage VG is on the Hi level, corresponding switching elements sw are turned on, and when a gate line scanning voltage VG is on the Low level, corresponding switching elements sw are turned off.

Figure 7:
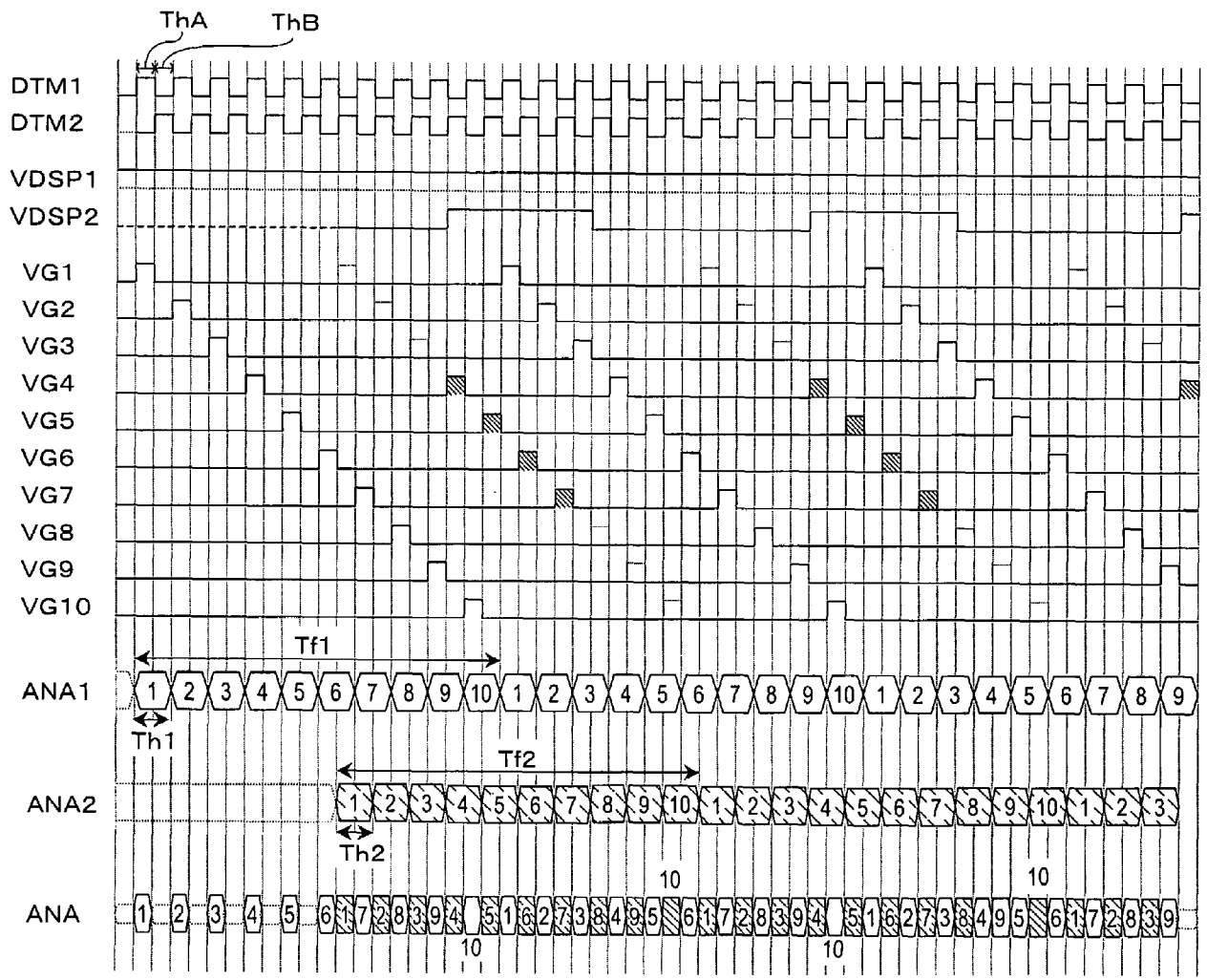
FIG. 7 is a timing chart of a dual scanning circuit in the first embodiment.

The dual scanning circuit 108 scans the horizontal lines based on two timings, i.e., the display timing signal DTM1 for the first video signal and the display timing signal DTM2 for the second video signal. First, as operation based on the signal DTM1 for the first video signal, the dual scanning circuit 108 selects a horizontal line sequentially, based on DTM1 as a clock. At that time, only when the vertical display period signal VDSP1 is on the display level, the gate line scanning voltage of the selection level is applied to the gate line of the selected horizontal line. Here, the period where the dual scanning circuit applies the gate line scanning voltage of the selection level to the gate line as operation based on DTM1 corresponds to a period where DTM1 is on the display level. Further, as described above, the signal synthetic circuit 107 applies the analog display signal ANA1 corresponding to the first video signal to the signal lines D in periods where DTM1 is on the display level. Accordingly, in a period where the dual scanning circuit 108 applies the gate scanning voltage of the selection level to a gate line of a certain horizontal line based on DTM1, the signal synthetic circuit 107 applies the analog display signal ANA1 of the first video signal corresponding to that horizontal line to the signal lines D. In FIG. 6, for example, the display level of VDSP1 is the Hi level and the gate scanning voltage of the selection level is applied to all the horizontal lines (here, the 1st to 10th horizontal lines) since VDSP1 is on the display level all over the frame period Th1. Next, as operation of the dual scanning circuit 108 based on DTM2 of the second video signal, the dual scanning circuit 108 selects a horizontal line sequentially, based on DTM2 as a clock. At that time, only when the vertical display period signal VDSP2 is on the display level, the gate line scanning voltage of the selection level is applied to the gate line of the selected horizontal line. Here, the period where the dual scanning circuit applies the gate line scanning voltage of the selection level to the gate line as operation based on DTM2 corresponds to a period where DTM2 is on the display level. Further, as described above, the signal synthetic circuit 107 applies the analog display signal ANA2 corresponding to the second video signal to the signal lines D in periods where DTM2 is on the display level. Accordingly, in a period where the dual scanning circuit 108 applies the gate scanning voltage of the selection level to a gate line of a certain horizontal line based on DTM2, the signal synthetic circuit 107 applies the analog display signal ANA2 of the second video signal corresponding to that horizontal line to the signal lines D. In FIG. 6, for example, the display level of VDSP2 is the Hi level and the gate scanning voltage of the selection level is applied to the 4th to 7th horizontal lines since VDSP2 is on the display level in the periods corresponding to the 4th to 7th horizontal lines. For reference, FIG. 7 shows a timing chart for explaining driving in the case where the frame period Tf1 of the first video signal and the frame period Tf2 of the second video signal are the same.

The dual scanning circuit 108 may be a circuit that mainly comprises a shift register or a circuit that mainly comprises a decoder. In the case of a circuit based on a shift register, each of the timing signals 111 and 112 includes at least start pulses for respectively determining heads of frames in the first and second video signal. In the case of a circuit based on a decoder, each of the timing signals 111 and 112 includes at least start pulses for respectively determining heads of frames in the first and second video signal, or address information specifying positions of the horizontal lines. In the case where the dual scanning circuit 108 is a circuit that mainly comprises a decoder and the timing signals 111 and 112 include address information specifying the positions of the horizontal lines, it is possible to select and display a horizontal line arbitrarily.

Figure 8:
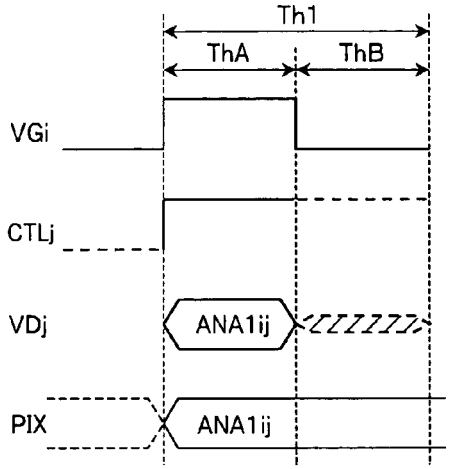
FIG. 8 is a timing chart of driving of a pixel in each display area in the first embodiment.
Figure 9:
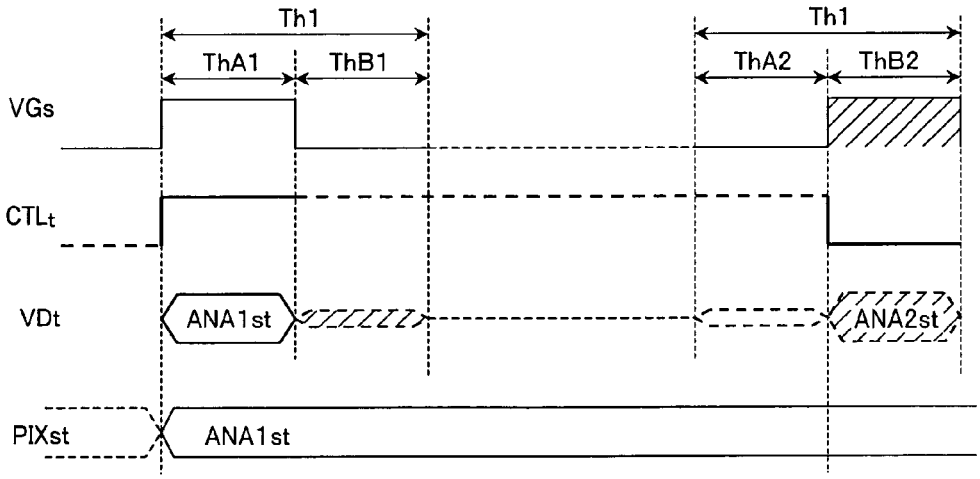
FIG. 9 is a timing chart of driving of a pixel in each display area in the first embodiment.
Figure 10:
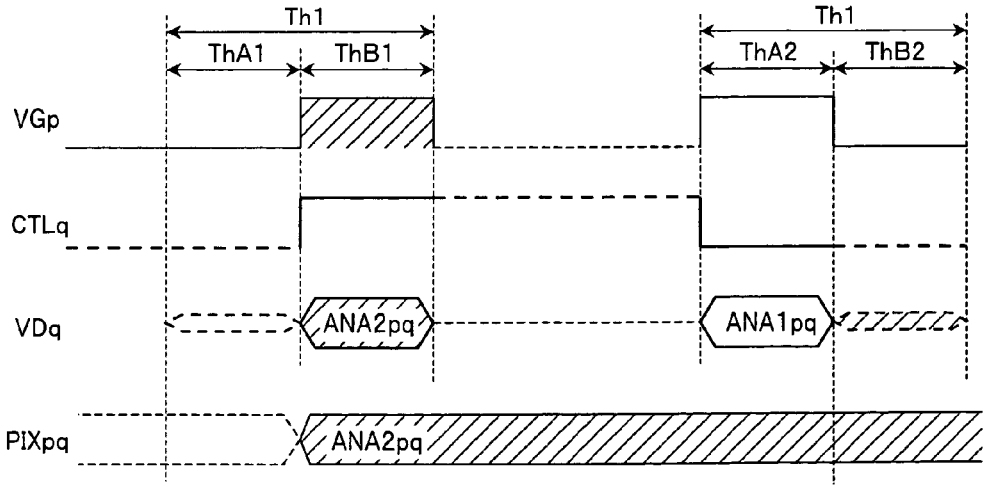
FIG. 10 is a timing chart of driving of a pixel in each display area in the first embodiment.

Next, referring to FIGS. 8 to 10, will be described operation of the horizontal display control circuit 109 and horizontal display operation of the display device 103.

Horizontal display operation of the display device 103 is controlled by the horizontal display control circuit 109. The display area control signal 113 (which is generated by the display control circuit 106 from the display control signal DCNT) includes a horizontal display area control signal for controlling operating states (signal-written or signal-non-written state) of pixels belonging to a horizontal line in a state of being selected by the dual scanning circuit 108. The horizontal display control circuit 109 receives this horizontal display area control signal, and applies a signal of a write enable level to horizontal display control lines CTL connected with pixels to which signal write operation is to be performed, among the pixels of the horizontal line in a state of being selected by the dual scanning circuit 108, and applies a signal of a write disable level to horizontal display control line CTL connected with pixels to which signal non-write operation is to be performed. In the following description, it is assumed that the write enable level for a horizontal display control line CTL is the Hi level, and the write disable level is the Low level and the switch element cnt included in each pixel 114 is an n-type TFT.

Now, referring to FIG. 8, will be described operation of a pixel (for example, a pixel PIXij of the i-th horizontal line and the j-th column) in a single display area (for example, the 1st to 3rd and 8th to 10th horizontal lines in the present embodiment) that displays the first video signal only (i.e., only one video signal) as shown in FIG. 4, in the display device 103. In FIG. 8, in a period ThA where the gate line scanning signal VGi is on the selection level, the signal synthetic circuit 107 applies the analog display signal ANA1ij corresponding to the first video signal of the pixel PIXij to the j-th the signal line Dj of the j-th column. In this period, the horizontal display control circuit 109 applies the Hi level to the horizontal display control line CTLj connected with the pixel PIXij. As a result, ANA1ij corresponding to the first video signal is applied to the liquid crystal Clc of the pixel PIXij, to hold an effective voltage corresponding to the display signal.

Next, referring to FIG. 9, will be described operation of a pixel (for example, a pixel PIXst of the s-th horizontal line and the t-th column) existing in an area (an area A of FIG. 4) where the first video signal is displayed within a horizontal line area (a synthetic display area, i.e., the 4th to 7th horizontal lines in the example of the present embodiment) that includes pixels displaying the first video signal and pixels displaying the second video signal as shown in FIG. 4, in the display device 103. In FIG. 9, in a period ThA1 where an analog display signal ANA1st of the first video signal is outputted from the signal synthetic circuit 107 and applied to the signal line Dt of the t-th column, the dual scanning circuit 108 outputs the Hi level as the gate line scanning signal VGs for the s-th horizontal line. In this period, the pixel PIXst displays the first video signal, and accordingly, the horizontal display control circuit 109 applies the Hi level onto the t-th horizontal display control line CTLt connected with the pixel PIXst. As a result, ANA1st corresponding to the first video signal is applied to the liquid crystal Clc of the pixel PIXst, to hold an effective voltage corresponding to the display signal. On the other hand, in a period ThB2 where an analog display signal ANA2st of the second video signal is outputted from the signal synthetic circuit 107 and applied to the t-th signal line Dt, the dual scanning circuit 108 outputs the Hi level as the gate line scanning signal VGs for the s-th horizontal line. In this period, the pixel PIXst does not display the second video signal, and accordingly, the horizontal display control circuit 109 applies the Low level onto the t-th horizontal display control line CTLt. As a result, even when the t-th horizontal line is in the selected state in the period ThB2, the analog display signal ANA2st of the second video signal is not applied to the pixel PIXst and the liquid crystal Clc holds the effective voltage corresponding to ANA1st of the first video signal.

Next, referring to FIG. 10, will be described operation of a pixel (for example, a pixel PIXpq of the p-th horizontal line and the q-th column) existing in an area (the area B of FIG. 4) where the second video signal is displayed within the synthetic display area shown in FIG. 4, in the display device 103. In FIG. 10, in a period ThB1 where an analog display signal ANA2pq of the second video signal is outputted from the signal synthetic circuit 107 and applied to the signal line Dq of the q-th column, the dual scanning circuit 108 outputs the Hi level as the gate line scanning signal VGp for the p-th horizontal line. In this period, the pixel PIXpq displays the second video signal, and accordingly, the horizontal display control circuit 109 applies the Hi level onto the q-th horizontal display control line CTLQ connected with the pixel PIXpq. As a result, ANA2pq corresponding to the second video signal is applied to the liquid crystal Clc of the pixel PIXpq, to hold an effective voltage corresponding to the display signal. On the other hand, in a period ThA2 where an analog display signal ANA1pq of the first video signal is outputted from the signal synthetic circuit 107 and applied to the q-th signal line Dq, the dual scanning circuit 108 outputs the Hi level as the gate line scanning signal VGp for the p-th horizontal line. In this period, the pixel PIXpq does not display the first video signal, and accordingly, the horizontal display control circuit 109 applies the Low level onto the q-th horizontal display control line CTLq. As a result, even when the q-th horizontal line is in the selected state in the period ThA2, the analog display signal ANA1pq of the first video signal is not applied to the pixel PIXpq and the liquid crystal Cls holds the effective voltage corresponding to ANA2pq of the second video signal.

Further, in a display area of a certain display signal within the synthetic display area in the above embodiment, the horizontal display control circuit 109 performs write operation of that video signal and thereafter stops write operation of the other video signal. However, in the case where two video signals inputted are different from each other in their frame frequencies, the following operation may be performed. Namely, in a display area (of the synthetic display area) where the video signal having the higher frame frequency is to be displayed, non-write operation of the video signal having the lower frame frequency is not performed and overwriting with the other video signal having the higher frame frequency is performed.

As described above, using the display device 103 of the first embodiment of the present invention, with inputs of two video signals supplied from two signal sources and control signals for controlling display areas of those two video signals, it is possible to display relevant videos in respective areas designated arbitrarily by the control signals.

Further, in the case where video signals are given from one signal source, when a video signal of a static image area displaying for example a background is outputted as a background video signal having a lower frame frequency, and a video signal of a dynamic image area displaying for example characters and texts is outputted as a foreground image video signal having a higher frame frequency together with control signals designating that dynamic image area, then, it is possible to lower the driving frequency in the display device 103 of the first embodiment of the present invention and to realize smaller power consumption.

Further, in the case where two input signal sources supply respective video signals having different frame frequencies from each other, it is possible to display relevant video signals asynchronously (i.e., without synchronizing frames of the two video signals) in respective display areas designated by signals for controlling display areas. As a result, it is possible to dispense with a frame memory (a memory having a capacity for storing display data of one screen) required for synchronization (picture synthesis) and to realize cost reduction and a slender frame part owing to reduction of a peripheral circuit area.

A first D/A converter 104 and a second D/A converter 105 may be positioned on only one side (only on the upper side) of the pixel array 110 as shown in FIG. 1, or (although not shown) on both sides (the upper and lower sides) of the pixel array 110. Further, a part or all of the first D/A converter 104, the second D/A converter 105, the signal synthetic circuit 107, the dual scanning circuit 108 and the horizontal display control circuit 109 may be positioned within the pixel array 110, namely on the glass substrate as a component of the pixel array 110. Further, a part or all of the first D/A converter 104, the second D/A converter 105, the signal synthetic circuit 107 and the horizontal display control circuit 109 may be implemented as one LSI (signal circuit). Or, the second D/A converter 105, the signal synthetic circuit 107 and the horizontal display control circuit 109 may be implemented as respective LSIs. It is favorable that, when the first and second D/A converters 104 and 105 have interface circuits, the first and second D/A converters 104 and 105 receive DATA1, SYNC1, DATA2 and SYNC2 directly from the first and second signal sources 101 and 102, and when the first and second D/A converters 104 and 105 have not interface circuits, the first and second D/A converters 104 and 105 receive DATA1, SYNC1, DATA2 and SYNC2 indirectly from the first and second signal sources 101 and 102 through the display control circuit 106.

The signal synthetic circuit 107 may be positioned on the downstream side (i.e., on the side of the pixel array 110) of the first and second D/A converters 104 and 105 as shown in FIG. 1 to synthesize the analog display signals ANA1 and ANA2, or (although not shown) on the upstream side (i.e., on the side of the first and second signal sources 101 and 102) of the first and second D/A converters 104 and 105 to synthesize the digital display signals DATA1 and DATA2.

Figure 11:
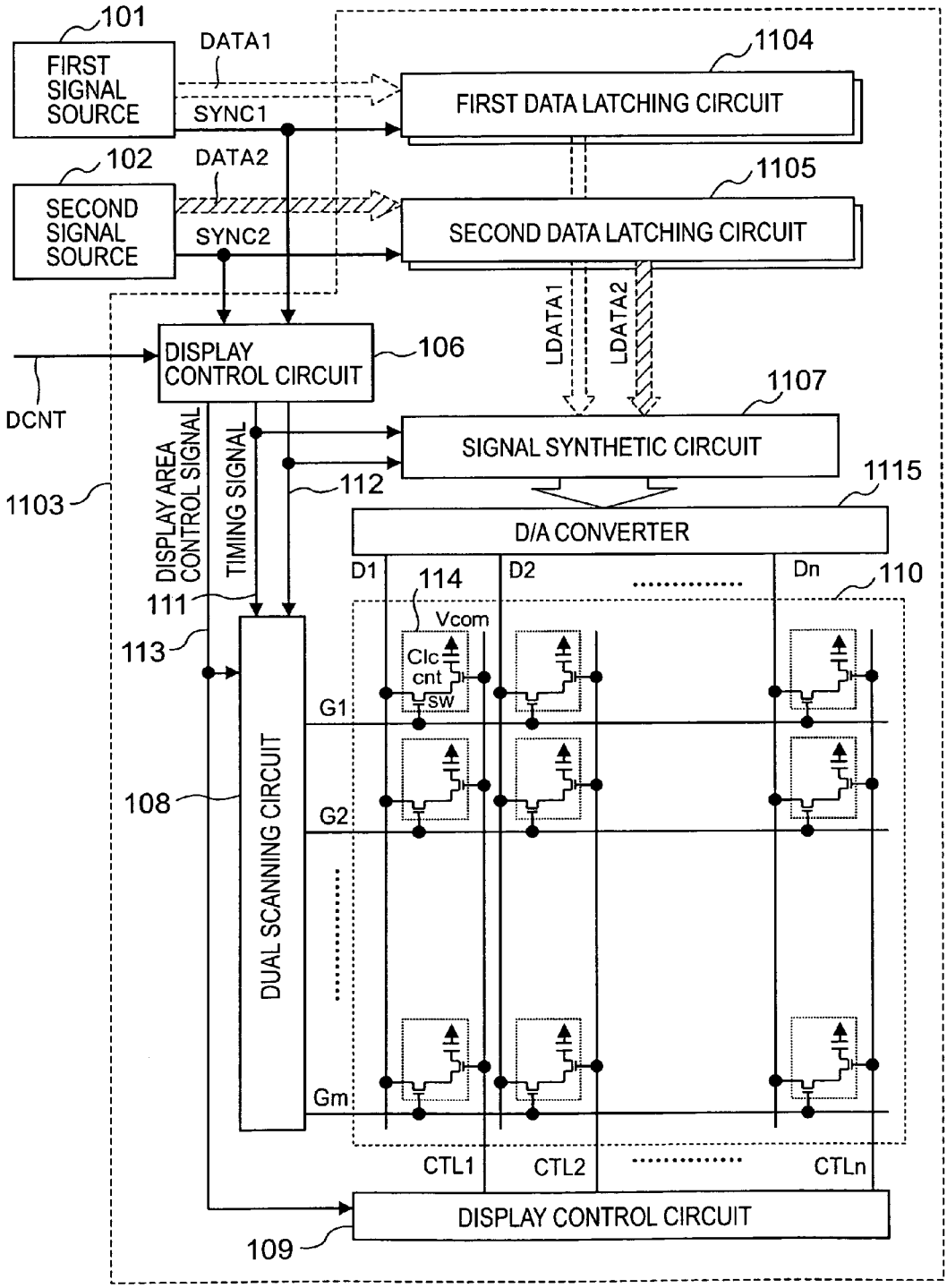
FIG. 11 is a schematic diagram showing a configuration of a display device in a second embodiment.

Next, referring to FIG. 11, will be described a display device and a driving method of a second embodiment according to the present invention. FIG. 11 is a schematic diagram showing a configuration of a display device as a second embodiment of the present invention. In the following description of the configuration of the display device referring to FIG. 11, the same components as ones in the display device of the first embodiment are shown by the same numbers and symbols in the figure and their description will be omitted.

A display device 1103 of the second embodiment according to the present invention is different from the display device 103 of the first embodiment in the processing path of the display signals. In the display device 1103, a first data latching circuit 1104 once stores the digital display signal DATA1 as the first video signal transferred from the first signal source 101, and outputs a digital display signal LDATA1 to a signal synthetic circuit 1107. Further, a second data latching circuit 1105 once stores the digital display signal DATA2 as the second video signal transferred from the second signal source 102, and outputs a digital display signal LDATA2 to the signal synthetic circuit 1107. Based on the display timing signals DTM1 and DTM2 described in the first embodiment of the present invention, the signal synthetic circuit 1107 selects one of the digital display signal LDATA1 inputted from the first data latching circuit 1104 and the digital display signal LDATA2 inputted from the second data latching circuit 1105, and outputs the selected signal to a D/A converter 1115. The D/A converter 1115 converts the digital display signal outputted from the signal synthetic circuit 1107 to an analog display signal ANA and outputs the analog display signal ANA to the signal lines Dx.

Next, will be described operation of the display device 1103. The first data latching circuit 1104 has at least two storage circuit. One storage circuit sequentially stores the digital display signal DATA1 transferred from the first signal source. And the other storage circuit stores at any point of time the display signal that the former storage circuit has stored sequentially, and outputs the digital display signal LDATA1 to the external device. Thus, for example, the former storage circuit sequentially stores the digital display signal DATA1 corresponding to one horizontal line. And thereafter and at any point of time before the display signal of the next one horizontal line is transferred, the latter storage circuit stores the display signal of the one horizontal line that is stored in the former storage circuit, and outputs the stored display signal as the digital display signal LDATA1. During the output of LDATA1 by the latter storage circuit, the former storage circuit sequentially stores the digital display signal DATA1 of the next one horizontal line. The first data latching circuit 1104 repeats this operation. Further, also the second data latching circuit 1105 has at least two storage circuit. One storage circuit sequentially stores the digital display signal DATA2 transferred from the second signal source. And the other storage circuit stores at any point of time the display signal that the former storage circuit has stored sequentially, and outputs the digital display signal LDATA2 to the external device. Thus, for example, the former storage circuit sequentially stores the digital display signal DATA2 corresponding to one horizontal line. And thereafter and at any point of time before the display signal of the next one horizontal line is transferred, the latter storage circuit stores the display signal of the horizontal line that is stored in the former storage circuit, and outputs the stored display signal as the digital display signal LDATA2. During the output of LDATA2 by the latter storage circuit, the former storage circuit sequentially stores the digital display signal DATA2 of the next one horizontal line. Also the second data latching circuit 1105 repeats this operation. The signal synthetic circuit 1107 selects the signal LDATA1 from the first data latching circuit 1104 in a period where the display timing signal DTM1 (for the first video signal) outputted from the display control circuit 106 is on the display level, and outputs the selected signal to the D/A converter 1115. In a period where the display timing signal DTM2 (for the second video signal) outputted from the display control circuit 106 is on the display level, the signal synthetic circuit 1107 selects the signal LDATA2 from the second data latching circuit 1105 and outputs the selected signal to the D/A converter 1115. The D/A converter 1115 converts a digital signal outputted from the signal synthetic circuit 1107 into a corresponding analog display signal ANA, and applies the analog display signal ANA onto the signal lines Dx.

As described above, the first data latching circuit 1104, the second data latching circuit 1105, the signal synthetic circuit 1107 and the D/A converter 1115 included in the display device 1103 of the second embodiment according to the present invention can perform the same function of generating the analog display signal ANA as the first D/A converter 104, the second D/A converter 105 and the signal synthetic circuit 107 included in the display device 103 of the first embodiment according to the present invention.

Thus, using the display device 1103 of the second embodiment according to the present invention, with inputs of two video signals supplied from two signal sources and control signals for controlling display areas of those two video signals, it is possible to display relevant videos in respective areas designated arbitrarily by the control signals.

Further, in the case where video signals are given from one signal source, when a video signal of a static image area displaying for example a background is outputted as a background video signal having a lower frame frequency, and a video signal of a dynamic image area displaying for example characters and texts is outputted as a foreground image video signal having a higher frame frequency together with control signals designating that dynamic image area, then, it is possible to lower the driving frequency in the display device 1103 of the second embodiment of the present invention and to realize smaller power consumption.

Further, in the case where two input signal sources supply respective video signals having different frame frequencies from each other, it is possible to display relevant video signals asynchronously (i.e., without synchronizing frames of the two video signals) in respective display areas designated by signals for controlling display areas. As a result, it is possible to dispense with a frame memory required for synchronization (picture synthesis) and to realize cost reduction and a slender frame part owing to reduction of a peripheral circuit area.

Next, referring to FIGS. 12 to 15, will be described a display device and a driving method of a third embodiment according to the present invention.

Figure 12:
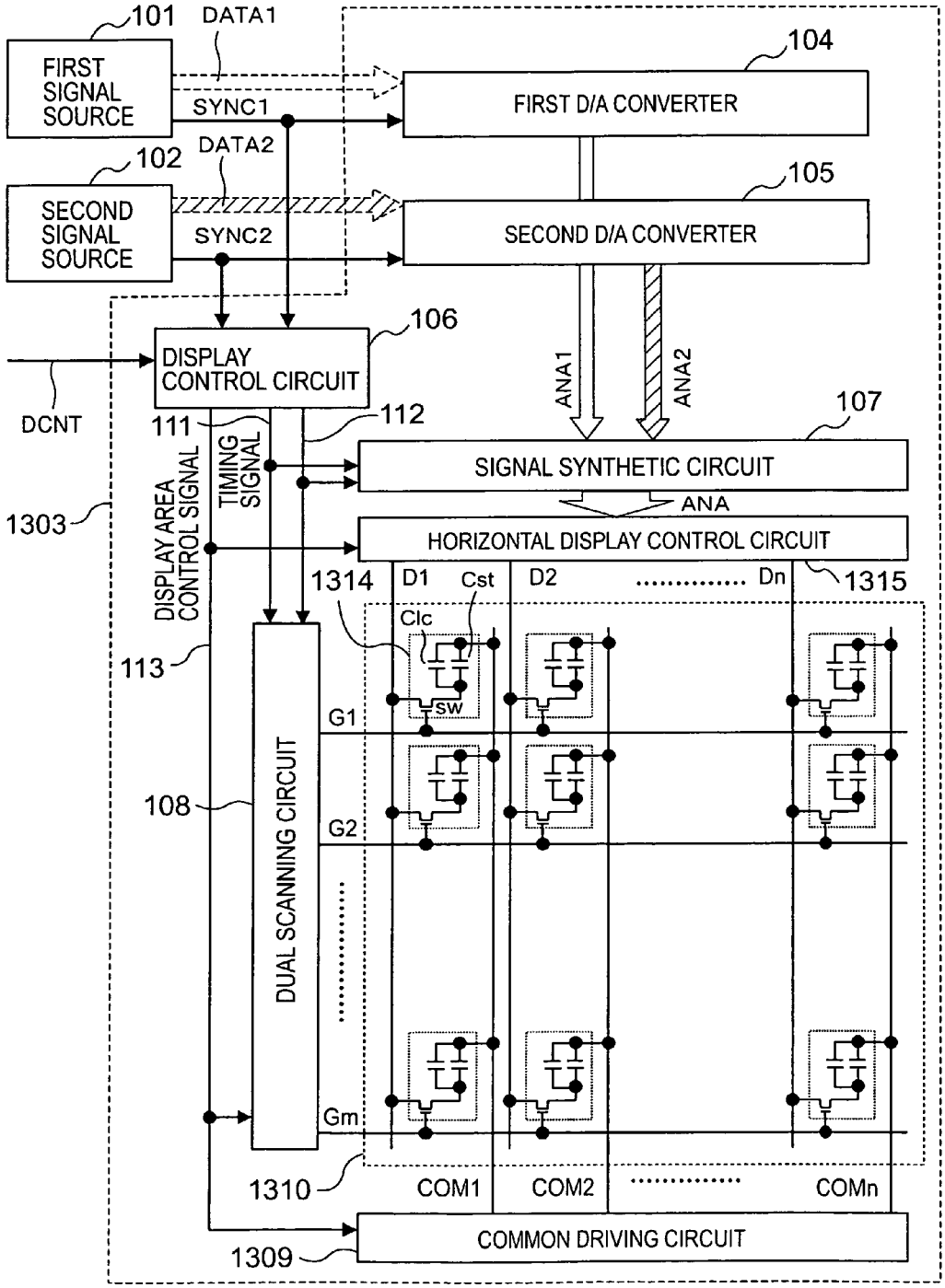
FIG. 12 is a schematic diagram showing a configuration of a display device in a third embodiment.

FIG. 12 is a schematic diagram showing a configuration of a display device as a third embodiment of the present invention. In the following description of the configuration of the display device referring to FIG. 12, the same components as ones in the display device of the first embodiment are shown by the same numbers and symbols in the figure and their description will be omitted.

The display device 1303 of the third embodiment according to the present invention is similar to the display device 103 of the first embodiment in the method of generating the analog display signal ANA based on signals of the signal sources and the method of controlling display areas in the vertical direction, while the display device 1303 is different from the display device 103 in a method of controlling display areas in the horizontal direction. Further, as a result of the difference in the method of controlling display areas in the horizontal direction, configurations of a pixel array 1310 and each pixel 1314 are different also.

First, the pixel array 1310 comprises: pixels 1314 arranged in a matrix having n (n is a natural number) pixels in each horizontal line and m (m is a natural number) pixels in each vertical line (column); n signal lines D1, D2, . . . , Dn arranged for supplying display signals to the pixel columns; n common lines COM1, COM2, . . . , COMn arranged for supplying a common electrode voltage to the pixel columns; and m gate lines G1, G2, . . . , Gm arranged for selecting n pixels arranged in the horizontal direction (hereinafter, referred to as one horizontal line) out of the pixels 1314 arranged in a matrix.

Now, will be described a configuration of each pixel 1314 included in this pixel array 1310. Each pixel 1314 comprises one switching element sw, a liquid crystal capacity Cls and a storage capacity Cst. Here, description is given taking an example where an n-type thin film transistor (TFT) is used as the switching element sw, although the switching element is not limited to this. In the figure, as for the switching element sw, its gate terminal is connected to a gate line Gy, its drain terminal (or its source terminal) to a signal line Dx, and its source terminal (or its drain terminal) is connected to a pixel electrode that applies a signal voltage onto the liquid crystal capacity Clc and the storage capacity Cst. The other electrode of the liquid crystal capacity Clc and the storage capacity Cst, i.e., a common electrode COM, is connected to a common line COMx, and is applied with the common electrode voltage Vcom. When the switching element sw in the pixel 1314 is ON, an analog display signal, which is applied to the signal line Dx, is applied o the pixel electrode. When the switching element sw is OFF, a potential difference between the pixel electrode and the common electrode COM is held in the liquid crystal capacity Clc and the storage capacity Cst.

On the other hand, in the configuration of the display device 1303 (shown in FIG. 12) of the third embodiment according to the present invention, circuits for controlling display areas in the horizontal direction are a horizontal display control circuit 1315 and a common driving circuit 1309. Based on a horizontal display area control signal included in the display area control signal 113 outputted from the display control circuit 106, the horizontal display control circuit 1315 selects the analog display signal ANA outputted from the signal synthetic circuit 107 or the signal of the write disable level, and applies the selected signal onto the signal line Dx. Further, also based on the horizontal display area control signal included in the display area control signal 113 outputted from the display control circuit 106, the common driving circuit 1309 selects the common electrode voltage Vcom on the write enable level or the common electrode voltage Vcom_n on the write disable level, and applies the selected voltage onto the common line COMx.

Figure 14:
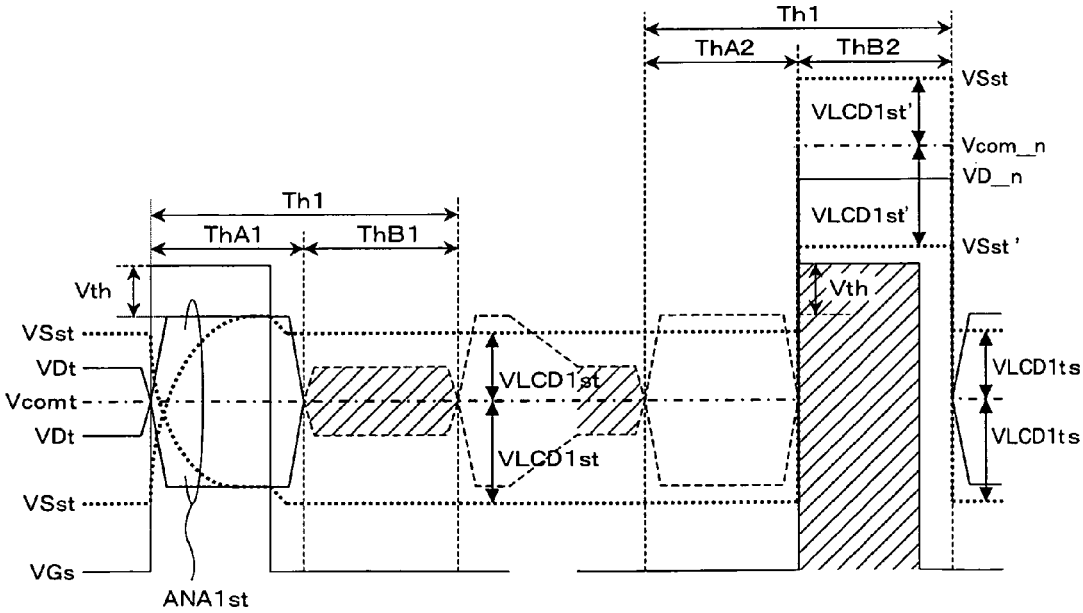
FIG. 14 is a timing chart of driving a pixel in each display area in the third embodiment.
Figure 15:
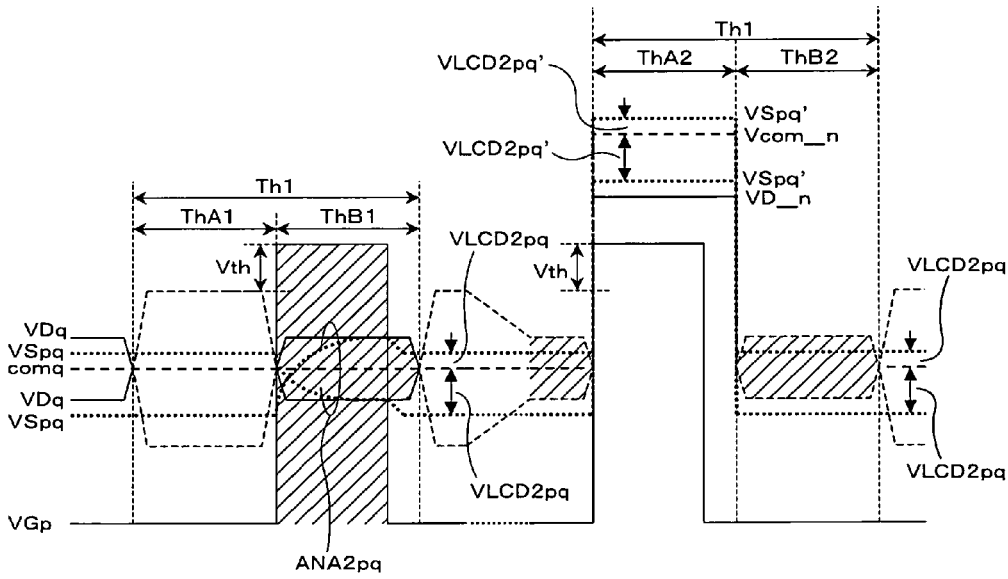
FIG. 15 is a timing chart of driving a pixel in each display area in the third embodiment.

Now, a method of controlling horizontal display areas will be described referring to FIG. 4 showing the simplified view of a display screen of the display device 1303, and FIGS. 13 to 15 respectively showing timing charts of driving voltages for pixels 1314 in display areas.

Figure 13:
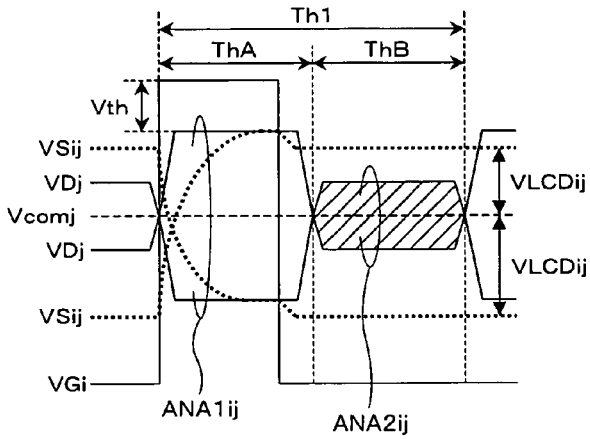
FIG. 13 is a timing chart of driving a pixel in each display area in the third embodiment.

Referring to FIG. 13, will be described operation of a pixel (for example, a pixel PIXij of the i-th horizontal line and the j-th column) in a single display area (for example, the 1st-3rd and 8th to 10th horizontal lines in the present embodiment) that displays the first video signal only (i.e., only one video signal) as shown in FIG. 4, in the display device 1303. Since the i-th horizontal line lies in the single display area where only the first video signal is displayed, the display control circuit 106 generates and outputs the horizontal display area control signal included in the display area control signal 113 such that, in a period ThA where the first video signal is to be displayed, the common driving circuit 1309 selects the common electrode voltage Vcom on the write enable level and applies the selected voltage onto the common lines COM and the horizontal display control circuit 1315 selects the analog display signal ANA outputted from the signal synthetic circuit 107 and outputs the analog display signal ANA onto the signal lines D. As a result, in the period ThA in FIG. 13, the gate line scanning signal VGi applies the selection level voltage onto the gate line of the i-th horizontal line. And the horizontal display control circuit 1315 selects the analog display signal ANA1ij (which is outputted from the signal synthetic circuit 107 in the same period) corresponding to the first video signal for the pixel PIXij, and outputs the selected analog display signal ANA1ij onto the j-th signal line Dj. Further, the common driving circuit 1309 selects the common electrode voltage Vcom on the write enable level and outputs the selected voltage onto the j-th common line COMJ. Here, for example, in the case where the switching element of the pixel 1314 is an n-type TFT, then, the selection level of the gate line scanning signal VG is a potential level that is higher than the highest voltage level of the analog display signals outputted from the D/A converters, by the threshold voltage Vth of the switching element sw or more. This is because the switching element sw included in the pixel in question becomes ON when the selection level voltage is applied, and the analog display signal ANA transferred from the signal line D is applied to the pixel electrode of the liquid crystal capacity Clc. As a result, the analog display signal ANA1ij is applied to the pixel electrode VSij of the pixel PIXij and the common electrode voltage Vcom is applied to the common electrode COMij so that the effective voltage VLCDij corresponding to the display signal is held in the liquid crystal capacity Clc and the storage capacity Cst.

Next, referring to FIG. 14, will be described operation of a pixel (for example, a pixel PIXst of the s-th horizontal line and the t-th column) in an area (an area A of FIG. 4) where the first video signal is displayed within a horizontal line area (a synthetic display area, i.e., the 4-th-7th horizontal lines in the example of the present embodiment) that includes pixels displaying the first video signal and pixels displaying the second video signal as shown in FIG. 4, in the display device 1303. Since the pixel PIXst is a pixel displaying the first video signal, the display control circuit 106 generates and outputs the horizontal display area control signal included in the display area control signal 113 such that, in a period ThAl where the first video signal is to be displayed, the common driving circuit 1309 selects the common electrode voltage Vcom on the write enable level and applies the selected voltage onto the t-th common line COMt and the horizontal display control circuit 1315 selects the analog display signal ANA1st (which corresponds to the first video signal) outputted from the signal synthetic circuit 107 and outputs the selected signal onto the t-th signal line Dt, and on the other hand, such that, in a period ThB2 where the second video signal is to be displayed, the common driving circuit 1309 selects the common electrode voltage Vcom_n on the write disable level and applies the selected voltage onto the t-th common line COMt and the horizontal display control circuit 1315 selects the write disable level voltage and outputs the selected voltage onto the t-th signal line Dt. As a result, in the period ThA1 in FIG. 14, the gate line scanning signal VGs applies the selection level voltage onto the gate line of the s-th horizontal line. And the horizontal display control circuit 1315 selects the analog display signal ANA1st (which is outputted from the signal synthetic circuit 107 in the same period) corresponding to the first video signal for the pixel PIXst and outputs the selected signal onto the t-th signal line Dt. Further, the common driving circuit 1309 outputs the common electrode voltage Vcom on the write enable level onto the t-th common line COMt. As a result, the analog display signal ANA1st is applied to the pixel electrode VSst of the pixel PIXst and the common electrode voltage Vcom on the write enable level is applied to the common electrode COMst so that the effective voltage VLCD1st corresponding to the display signal is held in the liquid crystal capacity Clc and the storage capacity Cst. On the other hand, in the period ThB2 where the second video signal is to be displayed, the gate line scanning signal VGs applies the selection level voltage onto the gate line of the s-th horizontal line and, in the same period, the horizontal display control circuit 1315 selects the write disable level voltage VD_n and outputs the selected voltage to the t-th signal line Dt and the common driving circuit 1309 outputs the common electrode voltage Vcom_n on the write disable level onto the t-th common line COMt. Here, it is assumed, for example, that the write disable level voltage VD_n selected by the horizontal display control circuit 1309 is more than or equal to the selection level voltage of the gate scanning signal VG. Further, here the write disable level voltage Vcom_n selected by the common driving circuit 1315 is set, for example, such that a pixel electrode potential VSst' after the change of the common electrode voltage becomes more than or equal to the selection level voltage of the gate scanning signal VG. As a result, also in the period ThB2, the switching element sw of the pixel PIXst is in the OFF state, and the pixel PIXst holds the effective voltage VLCDlst written in the period ThA1.

Next, referring to FIG. 15, will be described operation of a pixel (for example, a pixel PIXpq of the p-th horizontal line and the q-th column) in an area (the area B in FIG. 4) where the second video signal is displayed within a horizontal line area (a synthetic display area, i.e., the 4-th to 7th horizontal lines in the example of the present embodiment) that includes pixels displaying the first video signal and pixels displaying the second video signal as shown in FIG. 4, in the display device 1303. Since the pixel PIXpq is a pixel displaying the second video signal, the display control circuit 106 generates and outputs the horizontal display area control signal included in the display area control signal 113 such that, in a period ThBl where the second video signal is to be displayed, the common driving circuit 1309 selects the common electrode voltage Vcom on the write enable level and applies the selected voltage onto the q-th common line COMq and the horizontal display control circuit 1315 selects the analog display signal ANA2pq (which corresponds to the second video signal) outputted from the signal synthetic circuit 107 and outputs the selected signal onto the q-th signal line Dq, and on the other hand, such that, in a period ThA2 where the first video signal is to be displayed, the common driving circuit 1309 selects the common electrode voltage Vcom_n on the write disable level and applies the selected voltage onto the q-th common line COMq and further the horizontal display control circuit 1315 selects the write disable level voltage and applies the selected voltage onto the q-th signal line Dq. As a result, in the period ThB1 in FIG. 15, the gate line scanning signal VGp applies the selection level voltage onto the gate line of the p-th horizontal line. And the horizontal display control circuit 1315 selects the analog display signal ANA2pq (which is outputted from the signal synthetic circuit 107 in the same period) corresponding to the second video signal for the pixel PIXpq and outputs the selected signal onto the q-th signal line Dq. Further, the common driving circuit 1309 outputs the common electrode voltage Vcom on the write enable level onto the q-th common line COMq. As a result, the analog display signal ANA2pq is applied to the pixel electrode VSpq of the pixel PIXpq and the common electrode voltage Vcomq on the write enable level is applied to the common electrode COMpq so that the effective voltage VLCD2pq corresponding to the display signal is held in the liquid crystal capacity Clc and the storage capacity Cst. On the other hand, in the period ThA2 where the first video signal is to be displayed, the gate line scanning signal VGp applies the selection level voltage onto the gate line of the p-th horizontal line and, in the same period, the horizontal display control circuit 1315 selects the write disable level voltage VD_n and outputs the selected voltage to the q-th signal line Dq and the common driving circuit 1309 outputs the common electrode voltage Vcom_n on the write disable level onto the q-th common line COMq. As a result, also in the period ThA2, the switching element sw of the pixel PIXpq is in the OFF state and pixel PIXpq holds the effective voltage VLCD2pq written in the period ThB1.

In the above-described embodiment, the horizontal display control circuit 1309 and the common driving circuit 1315 operate in a display area of a certain display signal in the synthetic display area such that write operation of that video signal is performed and thereafter write operation of the other video signal is stopped. However, in the case where two video signal inputted have different frame frequencies from each other, it is possible that, in the synthetic display area, non-write operation of a video signal having a lower frame frequency is not performed in a display area where a video signal having a higher frame frequency is to be displayed and overwriting with the video signal having the higher frame frequency is performed.

As described above, using the display device 1303 of the third embodiment of the present invention, with inputs of two video signals supplied from two signal sources and control signals for controlling display areas of those two video signals, it is possible to display relevant videos in respective areas designated arbitrarily by the control signals.

Further, in the case where video signals are given from one signal source, when a video signal for a static image area displaying for example a background is outputted as a background video signal having a lower frame frequency and a video signal of a dynamic image area displaying for example characters and texts is outputted as a foreground image video signal having a higher frame frequency together with control signals designating that dynamic image area, then it is possible to lower the driving frequency in the display device 1303 of the third embodiment of the present invention and to realize smaller power consumption.

Further, in the case where two input signal sources supply respective video signals having different frame frequencies from each other, it is possible to display relevant video signals asynchronously (i.e., without synchronizing frames of the two video signals) in respective display areas designated by signals for controlling display areas. As a result, it is possible to dispense with a frame memory required for synchronization (picture synthesis) and to realize cost reduction and slender frame part owing to reduction of a peripheral circuit area.

Further, even when the fist D/A converter 104, the second D/A converter 105 and the signal synthetic circuit 107 included in the display device 1303 of the third embodiment of the present invention are replaced with the first data latching circuit 1104, the second data latching circuit 1105, the signal synthetic circuit 1107 and the D/A converter 115 as in the display device 1103 of the second embodiment of the present invention, it is possible to acquire results similar to the above ones.

Using a display device and a driving method of an embodiment according to the present invention in the case where two video signals supplied from two signal sources and signals for controlling display areas of those two video signals are inputted to that display device, it is possible to display relevant videos in respective areas designated arbitrarily by the control signals. In other words, it is possible to select any area to display any video in that area. Further, in the case of video signals supplied from one signal source, by outputting a video signal of a static image area displaying a background and the like as a background video signal having a lower frame frequency and outputting a video signal of a dynamic image area displaying characters, texts and the like as a foreground image video signal having a higher frame frequency together with control signals designating that dynamic image area, it is possible to realize a display device having a lower driving frequency and smaller power consumption. Further, in the case where two input signal sources supply respective video signals having different frame frequencies from each other, it is possible to display relevant video signals asynchronously (i.e., without synchronizing frames of the two video signals) in respective display areas designated by signals for controlling display areas. As a result, it is possible to dispense with a frame memory required for synchronization (picture synthesis) and to obtain a display device that realizes cost reduction and slender frame part owing to reduction of a peripheral circuit area.

What is claimed is:

1. A display device comprising:

a pixel array comprising a plurality of signal lines, a gate line crossing said plurality of signal lines, and pixels located correspondingly to cross portions of said plurality of signal lines and said gate line said pixels each comprising a first switching element controlled by said selection voltage supplied from said gate line and a second switching element controlled by a rewrite signal that controls rewriting of said display signals in respective pixels connected to said gate line a scanning circuit which applies a selection voltage onto said gate line;

a signal circuit which outputs said display signal corresponding to each of said pixels connected to said gate line that is applied with said selection voltage;

a plurality of horizontal display control lines arranged in said pixel array along said plurality of signal lines; and a horizontal display control circuit which outputs said rewrite signals, through said plurality of horizontal display control lines to said pixels;

wherein:

said horizontal display control circuit turns off the second switching elements included in a first pixel among said pixels for which the display signal is not to be rewritten among said pixels of which the first switching elements are in an ON state, and turns on the second switching element included in a second pixel for which the display signal is to be rewritten among said pixels of which the first switching elements are in the ON state.

2. A display device according to claim 1, wherein:

said display device flanker comprises a display control circuit which controls display areas of first and second display signals supplied from different signal sources from each other and display timing of said first and second display signals;

said signal circuit comprises a first D/A convener which converts said first display signal into a first analog display signal, a second D/A converter which converts said second display signal into a second analog display signal, and a signal synthetic circuit which synthesizes said first analog display signal from said first D/A converter and said second analog display signal from said second D/A converter; and based on control signals outputted from said display control circuit, said scanning circuit applies the selection voltage on said gate line according to a first scanning frequency of said first display signal and applies the selection voltage on said gate line according to a second scanning frequency of said second display signal.

3. A display device according to claim 2, wherein:

said display control circuit divides a horizontal period of a display signal having a shorter horizontal period between a first horizontal period of said first display signal and a second horizontal period of said second display signal; assigns at least one period acquired by the division of said shorter horizontal period, as first period where the selection voltage is applied to said gate line when said scanning circuit scans said gate line according to said first scanning frequency of said first display signal; and assigns at least another period as a second period where the selection voltage is applied to said gate line when said scanning circuit scans said gate line according to said second scanning frequency of said second display signal.

4. A display device according to claim 3, wherein:

based on a vertical display period signal outputted from said display control circuit, said scanning circuit selects said gate line to which the selection voltage is applied according to said first scanning frequency and said second scanning frequency;

based on a horizontal display area control signal outputted from said display control circuit, said horizontal display control circuit selects the pixel to which said first video signal is to be written or the pixel to which said second video signal is to be written among said pixels connected to said gate line to which the selection voltage is applied by said scanning circuit;

a first area of said pixel array displays said first display signal; and a second area of said pixel array displays said second display signal.

5. A display device according to claim 2, wherein:

at least one of said scanning circuit, said signal circuit, said horizontal display control circuit and said display control circuit is formed on a same substrate as said pixel array.

6. A display device according to claim 1, wherein:

said display device further comprises a display control circuit which controls display areas of first and second display signals supplied from different signal sources from each other and display timing of said first and second display signals;

said signal circuit comprises a first latching circuit which latches said first display signal, a second latching circuit which latches said second display signal, a signal synthetic circuit which synthesizes said first display signal outputted from said first latching circuit and said second display signal outputted from said second latching circuit, and a D/A converter which converts a synthesized display signal into an analog display signal; and based on control signals outputted from said display control circuit, said scanning circuit applies the selection signal on said gate line according to a first scanning frequency of said first display signal and applies the selection voltage on said gate line according to a second scanning frequency of said second display signal.

7. A display device comprising:

a pixel array comprising a plurality of signal lines, a gate line crossing said plurality of signal lines, a plurality of common lines crossing said gate line and arranged along said plurality of signal lines, and pixels located correspondingly to cross portions of said plurality of signal lines and said gate line, wherein each pixel comprises a liquid crystal cell, a storage capacity corresponding to said liquid crystal cell, and an n-type TFT element of which a gate is connected to said gate line, a drain is connected to one of said signal lines and a source is connected to a pixel electrode of said liquid crystal cell and said storage capacity, with a common electrode of said liquid crystal cell and said storage capacity being connected to one of said common lines;

a scanning circuit which applies a selection voltage onto said gate line;

a signal circuit which generates a display signal corresponding to each of said pixels connected to said gate line that is applied with said selection voltage;

a horizontal display control circuit which outputs said display signal that is generated by said signal circuit and correspond to a first pixels for which said display signal is to be rewritten, onto signal lines corresponding to said first pixel, among said pixels connected to said gate line to which the selection voltage is applied, and which outputs a potential that is higher than a potential that is lower than the selection voltage by a threshold voltage of said TFT element, onto signal lines corresponding to a second pixel for which display signal is not to be rewritten among said pixels connected to said gate line; and a common driving circuit which outputs a common electrode voltage as a reference potential to display signals outputted by said signal circuit, onto the common line corresponding to said first pixel, among said pixels connected to said gate line to which the selection voltage is applied, and which applies a voltage to the common line corresponding to said second pixel such that pixel electrode voltage of said second pixel has a higher potential than a potential that in turn is lower than the selection voltage by the threshold voltage of said TFT element;

wherein:

said horizontal display control circuit turns on the TFT element of said first pixels among said pixels connected to said gate line to which the selection voltage is applied, and turns off the TFT element of said second pixel.

8. A display device comprising:

a pixel array comprising a plurality of signal lines, a gate line crossing said plurality of signal lines, a plurality of common lines crossing said gate line and arranged along said plurality of signal lines, and pixels located correspondingly to cross portions of said plurality of signal lines and said gate line, wherein each pixel comprises a liquid crystal cell, a storage capacity corresponding to said liquid crystal cell, and a p-type TFT element of which a gate is connected to one of said gate line, a drain is connected to one of said signal lines and a source is connected to a pixel electrode of said liquid crystal cell and said storage capacity, with a common electrode of said liquid crystal cell and said storage capacity being connected to one of said common lines;

a scanning circuit which applies a selection voltage onto said gate line;

a signal circuit which generates a display signals corresponding to each of said pixels connected to said gate line that is applied with said selection voltage;

a horizontal display control circuit which outputs said display signal that is generated by said signal circuit and correspond to a first pixel for which said display signal is to be rewritten, onto the signal line corresponding to said first pixel, among said pixels connected to said gate line to which the selection voltage is applied, and which outputs a potential that is lower than a potential that is higher than the selection voltage by a threshold voltage of said TFT element, onto the signal line corresponding to a second pixel for which said display signal is not to be rewritten among said pixels connected to said gate line; and a common driving circuit which outputs a common electrode voltage as a reference potential to said display signal outputted by said signal circuit, onto the common line corresponding to said first pixel, among said pixels connected to said gate line to which the selection voltage is applied, and which applies a voltage to the common line corresponding to said second pixel such that pixel electrode voltages of said second pixel has a lower potential than a potential that in mm is higher than the selection voltage by a threshold voltage of said TFT element;

wherein:

said horizontal display control circuit turns on said TFT element of said first pixel and turns off said TFT element of said second pixel, among said pixels connected to said gate line to which the selection voltage is applied.

9. A display device, comprising:

a pixel array comprising a plurality of pixels arranged in a matrix;

a signal circuit which outputs a display signal from an outside to the pixels of said pixel array;

a scanning circuit which selects pixel line to which said display signal is to be outputted; and a horizontal display control circuit which selects pixel column to which said display signal is to he outputted, wherein said display signal from the outside includes a plurality of display signals of respective different signal sources; and in updating a part of display signals among said plurality of display signals of respective different signal sources, said horizontal display control circuit selects first pixel column corresponding to said part of display signals as said pixel column, and does not select second pixel column corresponding to display signals that are not to be updated.

10. A display device according to claim 9, wherein:

said signal circuit divides, along a time axis, each of said plurality of display signals of respective different signal sources, and outputs the divided signals to the pixels of said pixel array.

11. A display device according to claim 9, wherein:

said plurality of display signals of respective different signal sources are different from one another in at least one of a period of a horizontal synchronizing signal and a period of a vertical synchronizing signal; and said scanning circuit selects said pixel line according to respective periods of horizontal synchronizing signals and respective periods of vertical synchronizing signals of said plurality of display signals of respective different signal sources.

* * * * *